United States Patent [19]

Finkelstein

[11] Patent Number: 4,982,449

[45] Date of Patent: Jan. 8, 1991

[54] BACKING FOR FLEXIBLE MATERIALS ON CAP BRIMS OR THE LIKE

[75] Inventor: Harvey Finkelstein, Highland Mills, N.Y.

[73] Assignee: Tri-Seal International, Inc., Blauvelt, N.Y.

[21] Appl. No.: 441,473

[22] Filed: Nov. 27, 1989

[51] Int. Cl.[5] ..... A42B 1/02; A42B 1/04

[52] U.S. Cl. ..... 2/192; 2/195; 2/200

[58] Field of Search ..... 2/192, 180, 195, 187, 2/200

[56] References Cited

U.S. PATENT DOCUMENTS

| | | | |
|---|---|---|---|
| 662,282 | 11/1900 | Mattes | 2/200 |
| 1,190,427 | 7/1916 | Kromer, Jr. | 2/195 |
| 2,716,753 | 9/1955 | Gordon | 2/195 |
| 2,769,308 | 11/1956 | Krasno | 2/200 |
| 2,908,012 | 10/1959 | Feldman | 2/200 |
| 3,072,915 | 1/1963 | Henschel | 2/195 |
| 3,315,273 | 4/1967 | Bullaro | 2/187 |
| 3,365,727 | 1/1968 | Hoffman | 2/192 |
| 3,366,971 | 2/1968 | Scherz | 2/200 |
| 4,249,269 | 2/1981 | Price | 2/192 |
| 4,606,077 | 8/1986 | Phillips | 2/195 |

*Primary Examiner*—Thomas B. Will

*Attorney, Agent, or Firm*—Laubscher, Presta & Laubscher

[57] ABSTRACT

A cap brim or the like, comprising outer fabric layers joined to an intermediate backing by stitching. The backing comprises a middle layer of a foamed thermoplastic material, and outer layers of solid thermoplastic material bonded to both sides of the middle foamed layer. The outer solid layers serve as wipers to prevent the breaking off of pieces of the middle foamed layer when the outer fabric layers are stitched to the backing.

6 Claims, 2 Drawing Sheets

FIG. 2
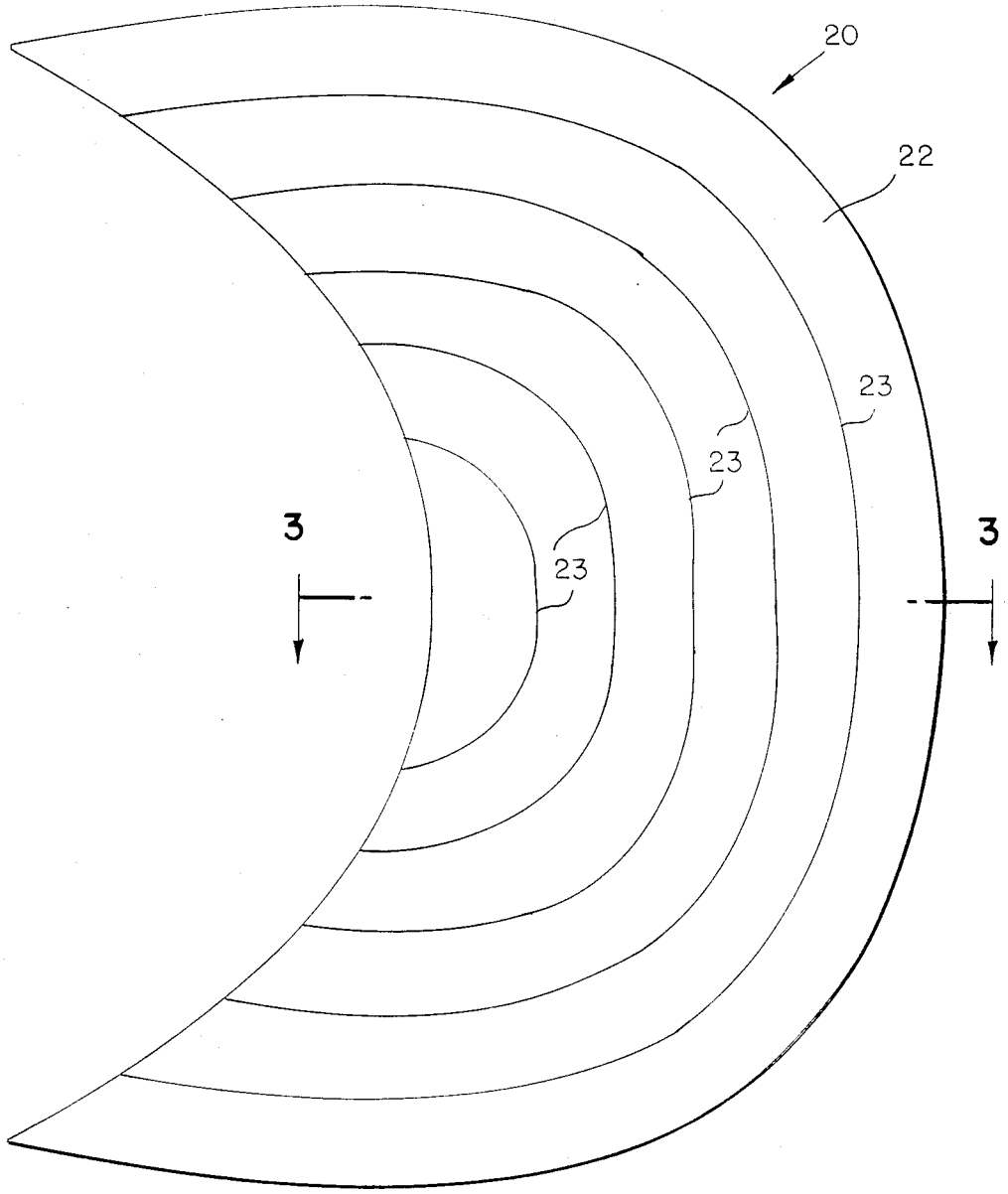
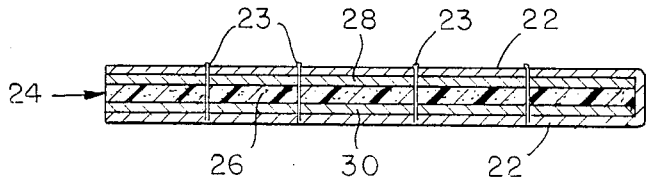
FIG. 3

BACKING FOR FLEXIBLE MATERIALS ON CAP BRIMS OR THE LIKE

BACKGROUND OF THE INVENTION

The present invention generally relates to backing materials for flexible materials, such as fabrics, and more particularly to a new and improved flexible backing material for fabrics on cap brims or the like.

Generally, when backing materials are required for fabrics used in wearing apparel, paper-type backings have been used. While such backings have provided adequate support for the fabric when the wearing apparel is new, they have been subject to deterioration when exposed to moisture or bending, and also when the wearing apparel has been washed or dry cleaned. Accordingly, after a short period of time, such paper-type backings have failed to provide proper support for the wearing apparel fabric. In the case of wearing apparel items such as caps with brims, for example, these items have to be discarded because of the deterioration of the paper-type backing even though the fabric itself is still suitable for use.

As a possible solution to paper-type backings, a layer of foamed thermoplastic material has been used as the backing for the fabric layers on a cap brim. The fabric layers are stitched to the backing to support them and maintain the desired shape of the cap brim. When the stitching needle is passed through the foam backing layer, small pieces of the foam tend to break off and move to the outside of the fabric layers. These small foam pieces adversely affect the appearance of the cap brim because they look like "dandruff" on the exterior of the fabric layers on the brim.

Accordingly, a need has arisen for a new and improved backing for fabrics on cap brims or the like, which is inexpensive, durable, water resistant, flexible, can be washed and dry cleaned without deteriorating, and is not subject to the aforementioned "dandruff" problem. The backing of the present invention fills this need.

SUMMARY OF THE INVENTION

The new and improved backing of the present invention generally is formed of solid and foamed thermoplastic material layers. The multi-layer construction comprises a first or middle layer of flexible, foamed thermoplastic material, and second and third thin layers of solid thermoplastic material bonded to both sides of the first layer. The second and third solid layers act as wipers of the needle leaving the particles in the foamed layer, thereby preventing the "dandruff" problem when the backing is stitched to the surrounding fabric layers of the cap brim.

BRIEF DESCRIPTION OF THE DRAWING

FIG. 2 is a plan view of a cap brim constructed in accordance with the principles of the present invention; and FIG. 3 is an enlarged sectional view taken substantially along line 3—3 in FIG. 2.

DESCRIPTION OF THE PREFERRED EMBODIMENTS

Figure 1:
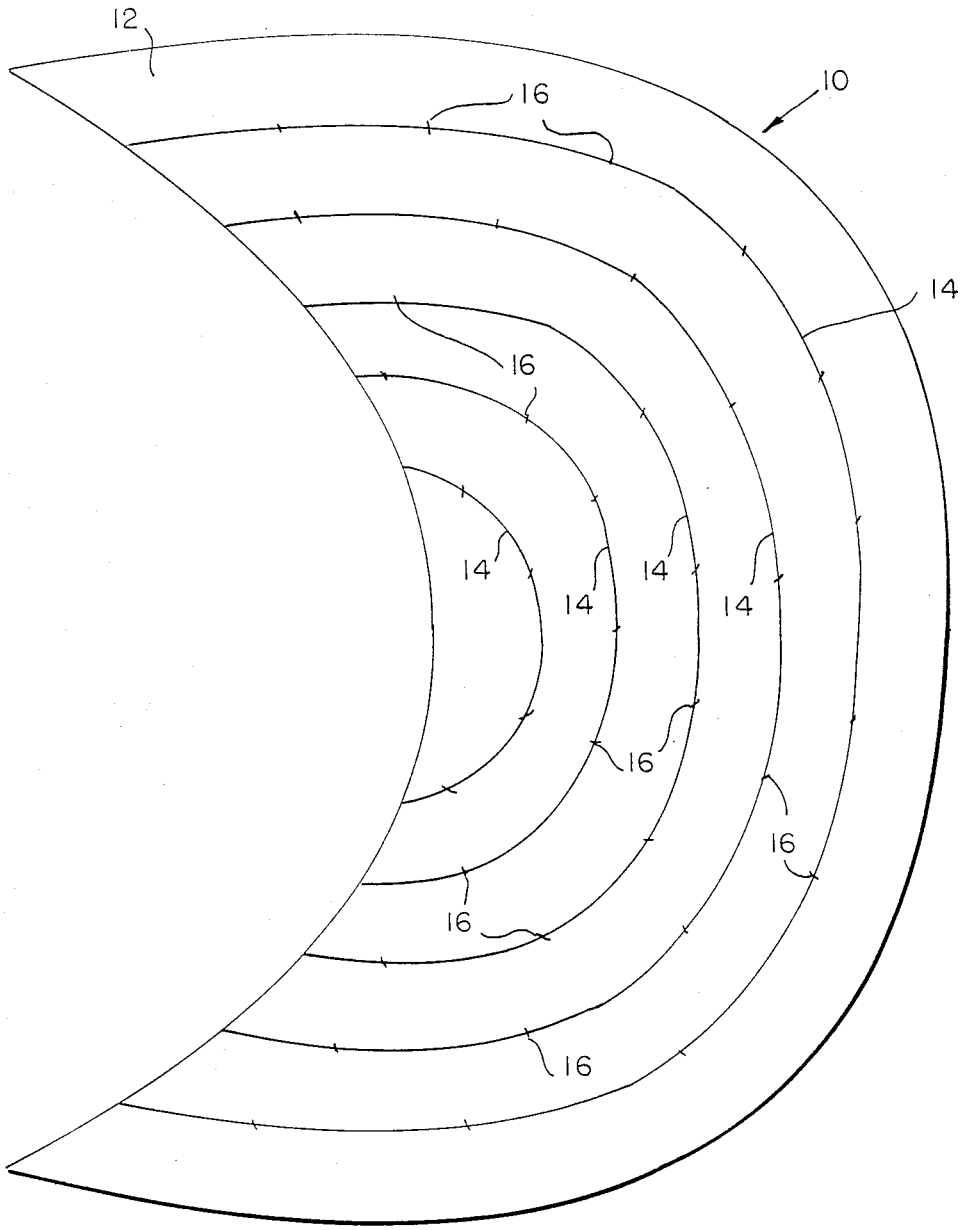
PRIOR ART FIG. 1
FIG. 1 is a plan view of a cap brim of the prior art wherein the backing is a layer of foamed thermoplastic material.

FIG. 1 illustrates a cap brim 10 of the type that is presently used. In this construction, upper and lower fabric layers 12, are supported by an intermediate layer (not shown) of a foamed thermoplastic material. The fabric layers 12 are secured to the intermediate foamed plastic layer by a plurality of generally equally spaced, parallel lines of stitching 14. As hereinbefore mentioned, small pieces 16 of the foamed layer break off and move to the outside of the outer fabric layers when the stitching needle (not shown) is passed through the foamed layer. These small foam pieces 16 adversely affect the appearance of the cap brim 10 because of their "dandruff"-like appearance on the exterior of the fabric layers 12.

A cap brim 20 constructed in accordance with the present invention is shown in FIGS. 2 and 3. In this construction, the outer fabric layers 22 are supported by and secured by stitching 23 to an intermediate backing 24 comprising a middle layer 26 of a flexible, foamed thermoplastic material and thin layers 28, 30 of a solid thermoplastic material bonded to both sides of the middle layer 26. The thin, solid outer layers 28, 30 act as wipers to prevent particles of the middle foamed layer 26 from breaking off when the needle is passed through the backing 24 to secure it to the fabric layers 22. This new and improved construction, therefore, serves to prevent the "dandruff" problem hereinbefore described, and also is more durable than the single foamed layer of the prior art.

As an illustrative example, the middle foamed layer 26 and the outer solid layers 28, 30 may be co-extruded in any suitable manner. The middle foamed layer 26 may be formed of any suitable thermoplastic material, such as foamed polyurethane or polyethylene. The outer solid layers may be formed of any suitable thermoplastic material such as polyethylene, polypropylene, polystyrene or acrylonitrile-butadiene-styrene. The outer layers 28, 30 preferably are thinner than the middle layer 26.

What is claimed is:

1. In a backing for outer fabric layers of a cap brim, wherein the outer fabric layers are stitched to the backing, the improvement wherein the backing comprises:

a. middle layer of foamed thermoplastic material; and b. outer layers of solid thermoplastic material bonded to both sides of said middle foamed layer, said outer solid layers serving as wipers to prevent the breaking off of pieces of said middle layer when the outer fabric layers are stitched to the backing.

2. The backing of claim 1 wherein said outer solid layers are thinner than said middle foamed layer.

3. The backing of claim 2 wherein said outer solid layers and said middle foamed layer are of co-extruded construction.

4. A cap brim, comprising:

outer fabric layers; and a backing disposed between said fabric layers and secured thereto by stitching;

said backing comprising a middle layer of foamed thermoplastic material, and outer layers of solid thermoplastic material bonded to both sides of said middle foamed layer, said outer solid layers serving to reinforce and seal said middle layer to prevent the breaking off of pieces of said middle layer when the outer fabric layers are stitched to said backing.

5. The cap brim of claim 4 wherein said outer solid layers are thinner than said middle foamed layer.

6. The cap brim of claim 5 wherein said outer solid layers and said middle foamed layer are of co-extruded construction.

* * * * *